US005921184A

United States Patent [19]

Sugiyama et al.

[11] Patent Number: 5,921,184

[45] Date of Patent: Jul. 13, 1999

[54] INK FILM THICKNESS CONTROL METHOD FOR INK SUPPLY APPARATUS

[75] Inventors: Hiroyuki Sugiyama, Ibaragi; Teruhiko Hama, Tokyo, both of Japan

[73] Assignee: Komori Corporation, Tokyo, Japan

[21] Appl. No.: 08/884,349

[22] Filed: Jun. 27, 1997

[30] Foreign Application Priority Data

Jun. 27, 1996 [JP] Japan ..... 8-167144

[51] Int. Cl.[6] ..... B41F 31/05; B41F 31/10

[52] U.S. Cl. ..... 101/484; 101/365

[58] Field of Search ..... 101/365, 350.1, 101/350.2, 350.3, 350.4, 350.5, 351.3, 352.01, 352.05, 352.09, 485, DIG. 32, DIG. 38, 483, 484

[56] References Cited

U.S. PATENT DOCUMENTS

| | | | |
|---|---|---|---|
| 4,660,470 | 4/1987 | Kramp . | |
| 5,010,820 | 4/1991 | Loffler | 101/484 |
| 5,070,784 | 12/1991 | Nishida et al. | 101/365 |
| 5,148,747 | 9/1992 | Rodi et al. | 101/137 X |

FOREIGN PATENT DOCUMENTS

| | | |
|---|---|---|
| 58-201008 | 11/1983 | Japan . |
| 58-201010 | 11/1983 | Japan . |

*Primary Examiner*—J. Reed Fisher
*Attorney, Agent, or Firm*—Blakely Sokoloff Taylor & Zafman

[57] ABSTRACT

In an ink film thickness control method for an ink supply apparatus including an ink fountain for storing an ink, a plurality of ink fountain keys whose aperture ratios are independently adjusted to supply the ink in the ink fountain, an ink fountain roller to which the ink is supplied through the ink fountain keys, and an ink ductor roller for supplying the ink supplied to the ink fountain roller to a printing plate through an ink roller group in accordance with a feed operation, the aperture ratios of all the ink fountain keys and a rotation ratio of the ink fountain roller are set at predetermined values when the ink roller group has no ink. The ink roller group is rotated. The feed operation of the ink ductor roller is performed a predetermined number of times to form a first minimum ink film thickness distribution necessary for printing in accordance with a set value such that an ink film becomes thinner from an upstream to a downstream.

4 Claims, 7 Drawing Sheets

INK FILM THICKNESS CONTROL METHOD FOR INK SUPPLY APPARATUS

BACKGROUND OF THE INVENTION

The present invention relates to an ink film thickness control method for a printing press and, more particularly, to an ink film thickness control method for an ink supply apparatus for supplying an ink in an ink fountain to a printing plate through an ink roller group.

FIG. 10 shows the schematic arrangement of an ink supply apparatus in a web offset printing press. Referring to FIG. 10, reference numeral 1 denotes an ink fountain for storing an ink 2; 3, an ink fountain roller for supplying the ink stored in the ink fountain 1 to an ink roller group 6; 4, ink fountain keys arranged in the axial direction of the ink fountain roller 3; 5, an ink ductor roller arranged between the ink fountain roller 3 and the ink roller group 6; and 7, a printing plate mounted on a plate cylinder 20 to which the ink is supplied through the ink roller group 6.

In this ink supply apparatus, the ink 2 in the ink fountain 1 is supplied to the ink fountain roller 3 by adjusting the aperture ratios of the ink fountain keys 4. The ink supplied to the ink fountain roller 3 is supplied to the printing plate 7 on the plate cylinder 20 through the ink roller group 6 which is rotated in accordance with the feed operation of the ink ductor roller 5 in the operation of the printing press.

In the web offset printing press, when the printing plate is changed to a new printing plate 7, the aperture ratio of each ink fountain key and the rotation ratio of the ink fountain roller 3 are preset to values corresponding to the image of the printing plate 7. More specifically, the aperture ratio of each ink fountain key 4 and the rotation ratio of the ink fountain roller 3 are set to values corresponding to the image of the printing plate 7, and the ink 2 in the ink fountain 1 is supplied to the printing plate 7 through the ink roller group 6. In this case, test printing is performed before final printing to adjust the ink supply amount, thereby obtaining a satisfactory color tone. With this operation, a desired ink film thickness distribution (gradient of thickness of the ink film) is formed on the ink roller group 6.

In the conventional ink supply apparatus, however, when the printing plate is changed to the new printing plate 7, the ink film thickness distribution for the previous printing plate remains on the ink roller group 6. For this reason, the ink film thickness distribution for the previous printing plate must be gradually changed to the ink film thickness distribution for the new printing plate 7. This operation excessively requires adjustment of the ink supply amount and test printing until a satisfactory color tone is obtained, resulting in various problems including an increase in preparation time for printing, an increase in work load, waste of printing materials, a decrease in production efficiency, and an increase in cost.

Before exchange of the printing plate, the feed operation of the ink ductor roller 5 may be stopped to perform printing on blank paper, thereby nullifying the ink film thickness distribution on the ink roller group 6. With this operation, the ink roller group 6 has no ink. However, the ink film thickness distribution for the printing plate 7 must be formed on the ink roller group 6 from the beginning. In this case, a long time is required to obtain an equilibratory ink film thickness distribution, so the above-described various problems cannot be avoided. These problems are also posed when the ink roller group 6 has no ink in the initial state.

SUMMARY OF THE INVENTION

It is an object of the present invention to provide an ink film thickness control method for an ink supply apparatus, which can shorten the preparation time for printing, reducing the work load, and saving printing materials, thereby realizing an increase in production efficiency and cost reduction.

In order to achieve the above object, according to the present invention, there is provided an ink film thickness control method for an ink supply apparatus including an ink fountain for storing an ink, a plurality of ink fountain keys whose aperture ratios are independently adjusted to supply the ink in the ink fountain, an ink fountain roller to which the ink is supplied through the ink fountain keys, and an ink ductor roller for supplying the ink supplied to the ink fountain roller to a printing plate through an ink roller group in accordance with a feed operation, comprising the steps of setting the aperture ratios of the ink fountain keys and a rotation ratio of the ink fountain roller at predetermined values when the ink roller group has no ink, rotating the ink roller group, and performing the feed operation of the ink ductor roller a predetermined number of times to form a first minimum ink film thickness distribution necessary for printing such that an ink film becomes thinner from an upstream to a downstream in accordance with a set value.

DESCRIPTION OF THE PREFERRED EMBODIMENT

The present invention will be described below in detail with reference to the accompanying drawings.

Figure 2:
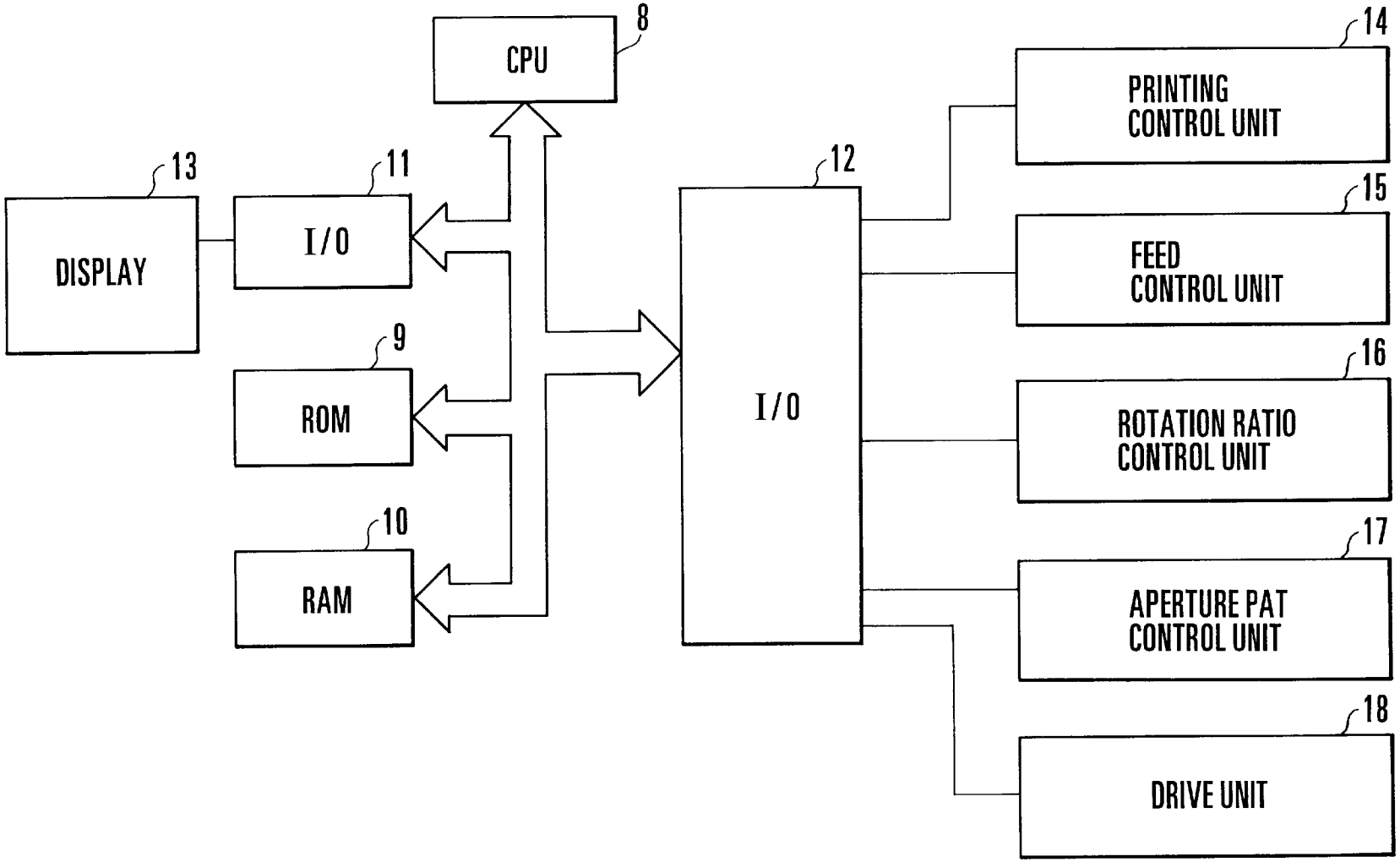
FIG. 2 is a block diagram showing the arrangement of an ink supply apparatus for controlling the thickness of an ink film according to the present invention.

FIG. 2 shows the arrangement of an ink supply apparatus for controlling the thickness of an ink film according to the present invention. Referring to FIG. 2, reference numeral 8 denotes a CPU (Central Processing Unit) for performing various processing operations; 9, a ROM (Read Only Memory) storing a program for ink supply; 10, a RAM (Random Access Memory) for storing various data; 11 and 12, I/O interfaces; 13, a touch panel display; 14, a printing control unit for controlling a printing press; 15, a feed control unit for ON/OFF-controlling a feed mechanism for feeding an ink; 16, a rotation ratio control unit for controlling the rotation ratio of an ink fountain roller; 17, an aperture ratio control unit for controlling aperture ratios of ink fountain keys; and 18, a drive unit for driving a floppy disk.

Upon receiving various input data through the I/O interfaces 11 and 12, the CPU 8 performs various processing operations while accessing the RAM 10 in accordance with the program stored in the ROM 9. Various processing data of the CPU 8 are output to the display 13, the printing control unit 14, the feed control unit 15, the rotation ratio control unit 16, the aperture ratio control unit 17, and the drive unit 18 through the I/O interfaces 11 and 12.

Figure 3:
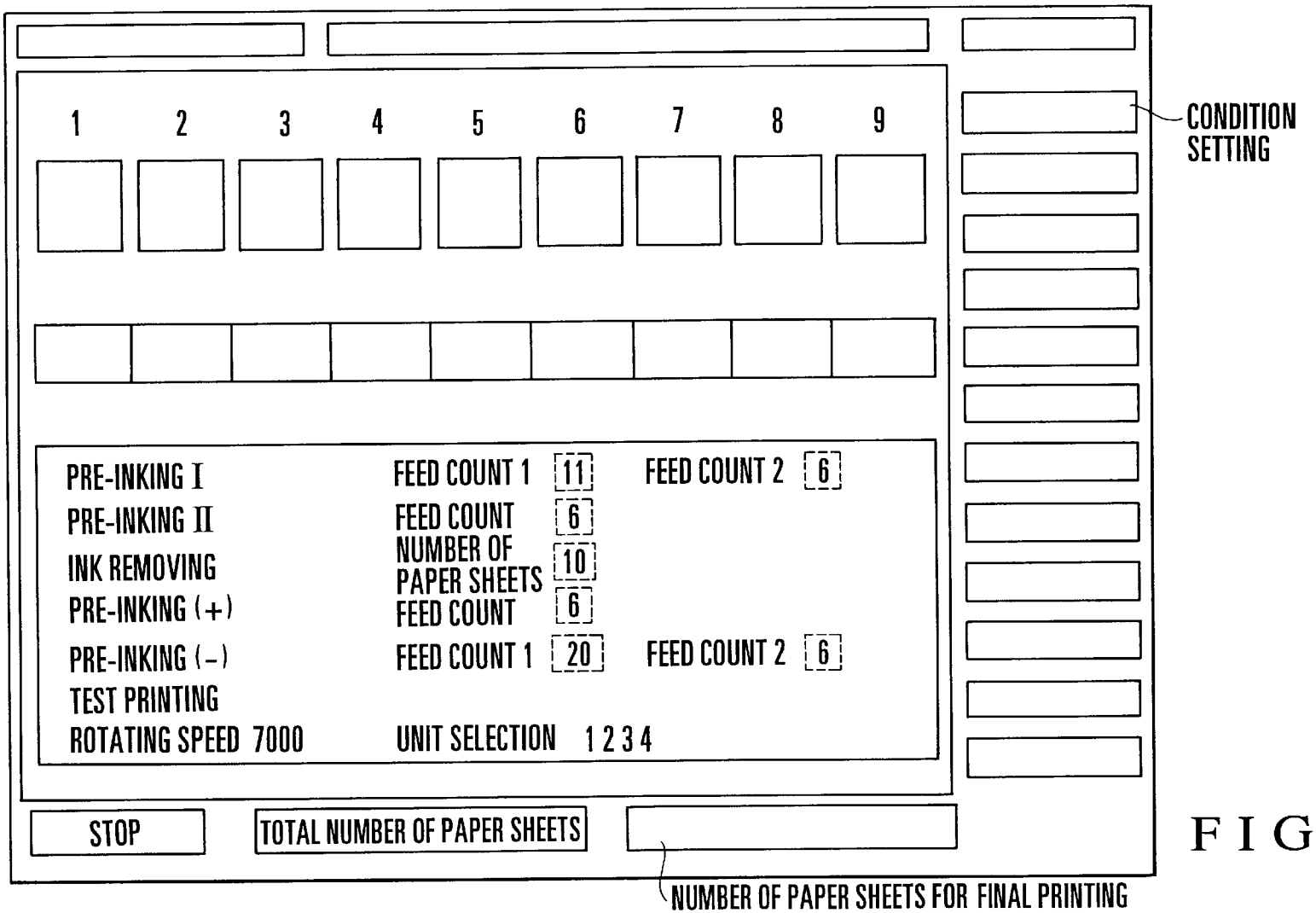
FIG. 3 is a view showing an ink film thickness control screen displayed on a display shown in FIG. 2.

FIG. 3 shows an ink film thickness control screen displayed on the display 13. The display 13 is arranged on an operation console (not shown). Ink film thickness control modes, i.e., "pre-inking I", "pre-inking II", "ink removing", "pre-inking (+)", and "pre-inking (−)" are displayed on the ink film thickness control screen.

The operations of the ink film thickness control modes will be described below with reference to FIGS. 1 and 5 to 8.

[Pre-Inking I]

Figure 10:
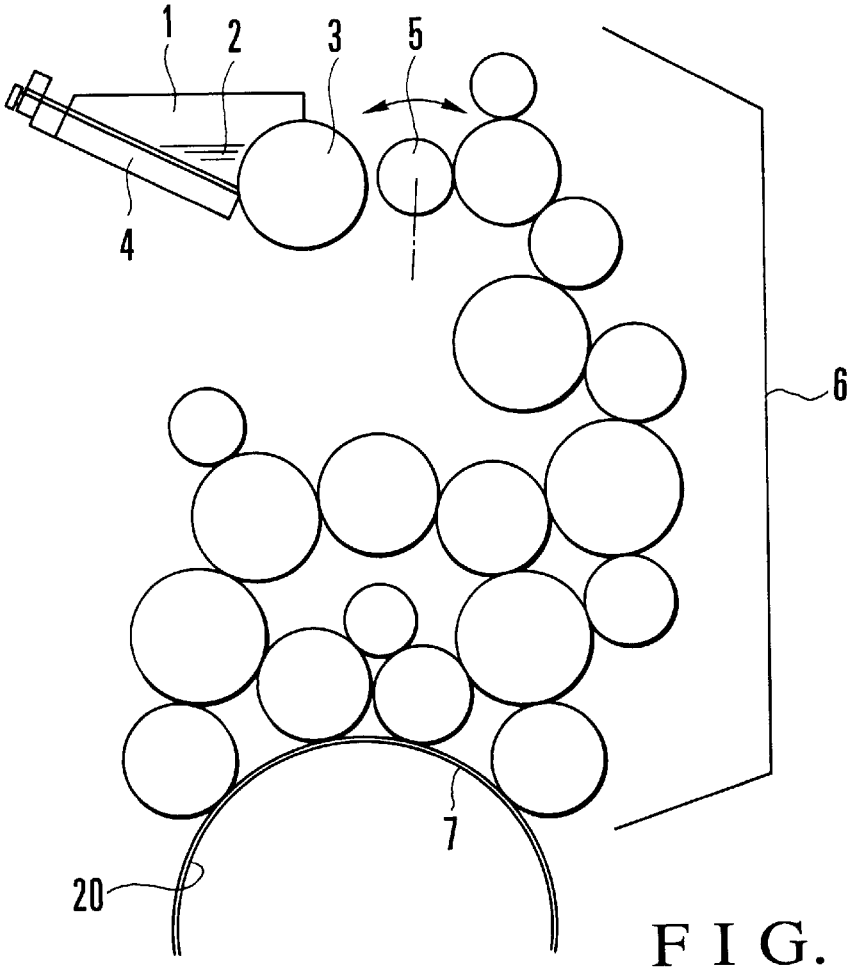
FIG. 10 is a view showing the schematic arrangement of an ink supply apparatus in a web offset printing press.

Assume that an ink film thickness distribution corresponding to the image of a printing plate 7 is to be formed on an ink roller group 6 shown in FIG. 10. If the ink roller group 6 has no ink, "pre-inking I" is selected on the ink film thickness control screen of the display 13. More specifically, with a touch on the display area of "pre-inking I" on the ink film-thickness control screen of the display 13, the CPU 8 performs control shown in FIG. 1.

Figure 1:
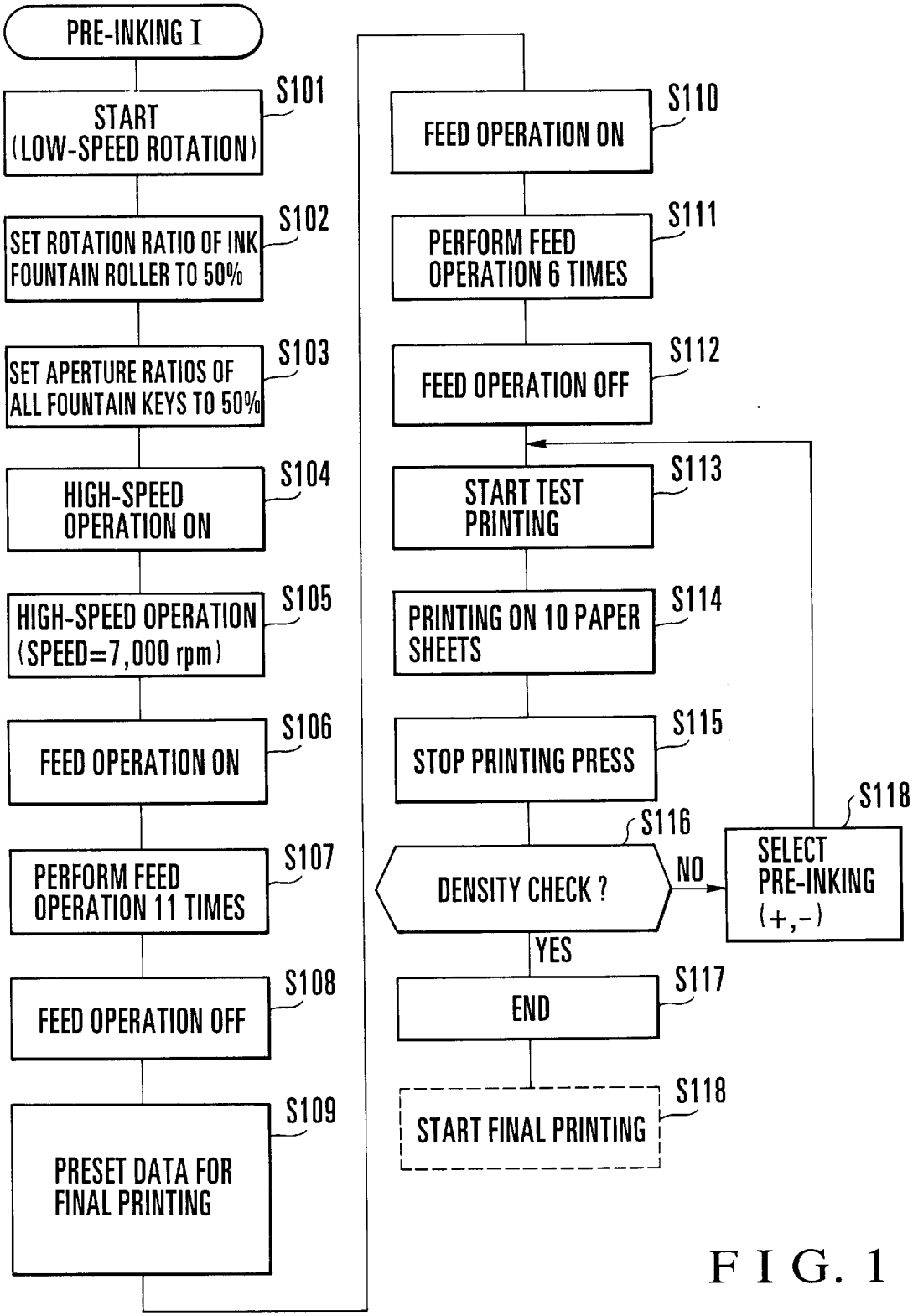
FIG. 1 is a flow chart for explaining an ink film thickness control operation based on "pre-inking I"

In FIG. 1, when "pre-inking I" is selected, the CPU 8 sends an instruction to the printing control unit 14 to rotate the printing press at a low speed (step S101). Next, the CPU 8 sends an instruction to the rotation ratio control unit 16 to set the rotation ratio of an ink fountain roller 3 at 50% (step S102). In addition, an instruction is sent to the aperture ratio control unit 17 to set the aperture ratios of all ink fountain keys 4 at 50% (step S103). Next, the CPU 8 sends an instruction to the printing control unit 14 to start the high-speed operation (step S104), thereby operating the printing press at a high speed (step S105).

Figures 4A, 4B, 4C:
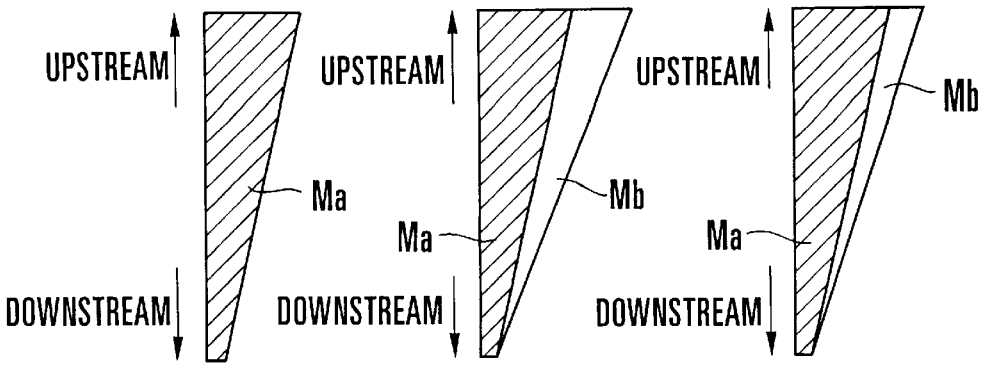
FIGS. 4A to 4C are views showing ink film thickness distributions M*a* and M*b* formed on an ink roller group shown in FIG. 2.

When the printing press reaches a predetermined operation speed (7,000 rpm), the CPU 8 sends an instruction to the feed control unit 15 to start the ink feed operation (step S106). After the feed operation by an ink ductor roller 5 is performed 11 times (step S107), the feed operation is stopped (step S108). With this operation, a minimum ink film thickness distribution necessary during printing is formed on the rotating ink roller group 6 such that the ink film becomes thinner from the upstream to the downstream, as shown in FIG. 4A. In other words, an ink film thickness distribution (gradient of the thickness of the ink film). M*a* corresponding to a portion without any image is formed.

Thereafter, the CPU 8 sends instructions to the aperture ratio control unit 17 and the rotation ratio control unit 16 to preset the aperture ratio of each ink fountain key 4 and the rotation ratio of the ink fountain roller 3 to values corresponding to the image of the printing plate 7 (step S109). More specifically, the CPU 8 reads out an image area ratio for a zone of the printing plate 7 in correspondence with each ink fountain key 4 from the floppy disk set in the drive unit 18. Subsequently, the aperture ratio of each ink fountain key 4 and the rotation ratio of the ink fountain roller 3 are obtained in correspondence with the readout image area ratio and preset as data for final printing.

In this embodiment, an image area ratio measuring device as disclosed in Japanese Patent Laid-Open No. 58-201008 or 58-201010 filed by the present applicant is used to measure the image area ratio of each zone of the printing plate 7. The image area ratio measured using this image area ratio measuring device is written in the floppy disk, and the floppy disk in which the image area ratio is written is set in the drive unit 18. The CPU 8 may be connected to the image area ratio measuring device to directly fetch the image area ratio for each zone of the printing plate 7 from the image area ratio measuring device.

Next, the CPU 8 sends an instruction to the feed control unit 15 to start the feed operation (step S110). After the feed operation of the ink ductor roller 5 is performed six times (step S111), the feed operation is stopped (step S112). With this operation, the minimum ink film thickness distribution M*a* necessary during printing, which is formed on the ink roller group 6, is superposed with an ink film thickness distribution M*b* corresponding to the image of the printing plate 7, as shown in FIGS. 4B and 4C.

FIG. 4B shows an ink film thickness distribution for a zone with a number of images. The minimum ink film thickness distribution M*a* is superposed with the ink film thickness distribution M*b* with a large gradient. FIG. 4C shows an ink film thickness distribution for a zone with a few images. The minimum ink film thickness distribution M*a* is superposed with the ink film thickness distribution M*b* with a small gradient.

Next, the CPU 8 sends an instruction to the printing control unit 14 to start test printing (step S113). After test printing is performed 10 times (step S114), the printing press is stopped (step S115). The operator checks the density of test-printed matter (step S116). If the test-printed matter has a satisfactory color tone, ink film thickness control based on "pre-inking I" is ended (step S117), and final printing starts (step S118).

If, in step S116, the test-printed matter has no satisfactory color tone, the operator selects "pre-inking (+)" or "pre-inking (−)" on the ink film thickness control screen of the display 13 (step S118). With this processing, the ink supply amount can be finely adjusted so that an almost satisfactory color tone can be obtained. Ink film thickness control based on "pre-inking (+)" or "pre-inking (−)" will be described later.

In this "pre-inking I", the rotation ratio of the ink fountain roller 3 is set at 50% in step S102, and the aperture ratio of the ink fountain key 4 is set at 50% in step S103. However, these are merely set values and not limited. The number of times of ink feed operations in step S107 or S111 and the number of times of test printing in step S114 are also set values and not limited. These values can be changed in accordance with the situation.

[Ink Removing]

When the printing plate is to be exchanged, "ink removing" is selected prior to exchange of the printing plate. More specifically, with a touch on the display area of "ink removing" on the ink film thickness control screen of the display 13, the CPU 8 performs control shown in FIG. 5.

Figure 5:
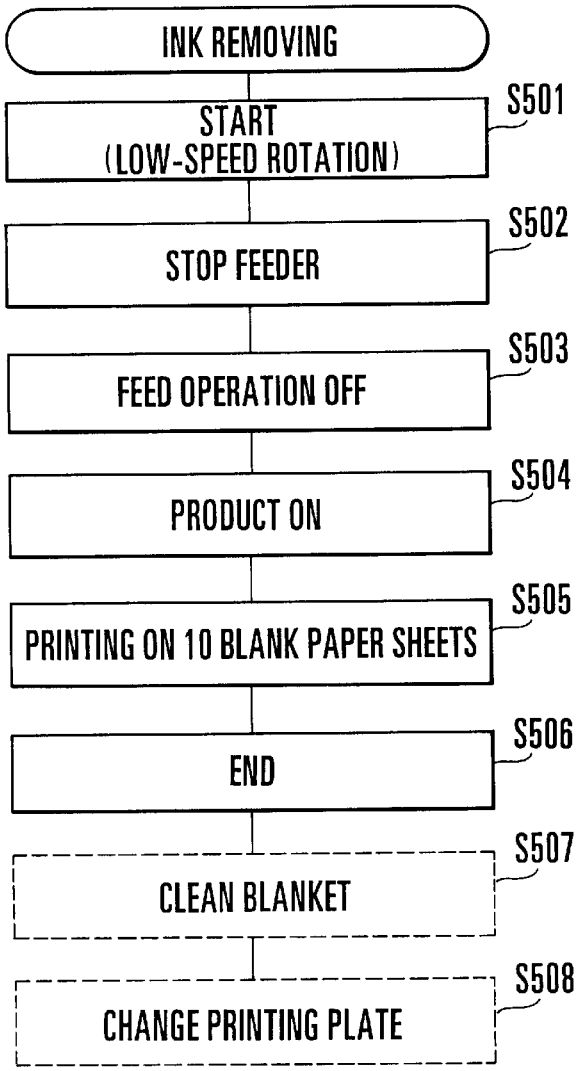
FIG. 5 is a flow chart for explaining an ink film thickness control operation based on "ink removing"

In FIG. 5, the CPU 8 sends an instruction to the printing control unit 14 to rotate the printing press at a low speed (step S501) and stop the feeder (step S502). In addition, the CPU 8 sends an instruction to the feed control unit 15 to stop the feed operation (step S503).

Next, the CPU 8 operates the printing press at a predetermined operation speed (step S504) and performs printing on 10 blank paper sheets (step S505). In this case, an ink film thickness distribution corresponding to the image of the previous printing plate is formed on the ink roller group 6. When the feed operation of the ink ductor roller 5 is stopped, and the printing press is operated while keeping the printing plate mounted, the ink on the ink roller group 6 is consumed, and the ink film thickness gradually becomes small. A large quantity of ink is consumed for a zone with a number of images, and a small quantity of ink is consumed for a zone with a few images. After printing is performed on the 10 blank paper sheets, the minimum ink film thickness distribution M*a* (FIG. 4A) necessary during printing is left on the ink roller group 6.

More specifically, in this embodiment, by appropriately setting the number of blank paper sheets printed in step S505, the ink film thickness distribution M*b* corresponding to the image of the printing plate 7 is removed from the ink roller group 6. In this case, the number of blank paper sheets printed in step S505 can be obtained from preset data in final printing for the printing plate. More specifically, the ink supply amount can be known on the basis of the preset data in final printing, so that the number of paper sheets necessary for consuming the ink left on the ink roller group 6 according to the ink film thickness distribution M*b* can be known in correspondence with the image of the printing plate. When this relationship is defined by performing a test a number of times, the number of blank paper sheets for leaving the minimum ink film thickness distribution M*a* necessary during printing in step S505 can be obtained. The number of blank paper sheets in step S505 can be freely set by the operator by an input operation using a ten-key pad or the like.

In this way, "ink removing" is ended while leaving the minimum ink film thickness distribution M*a* necessary during printing on the ink roller group 6 (step S506). After "ink removing", the operator cleans the blanket (step S507) and changes the printing plate to the new printing plate.

[Pre-Inking II]

While the minimum ink film thickness distribution M*a* necessary during printing is left on the ink roller group 6 by "ink removing", the operator cleans the blanket and changes the printing plate to the new printing plate 7. After exchange of the printing plate, when the operator selects "pre-inking II" on the ink film thickness control screen of the display 13, the CPU 8 performs control shown in FIG. 6.

Figure 6:
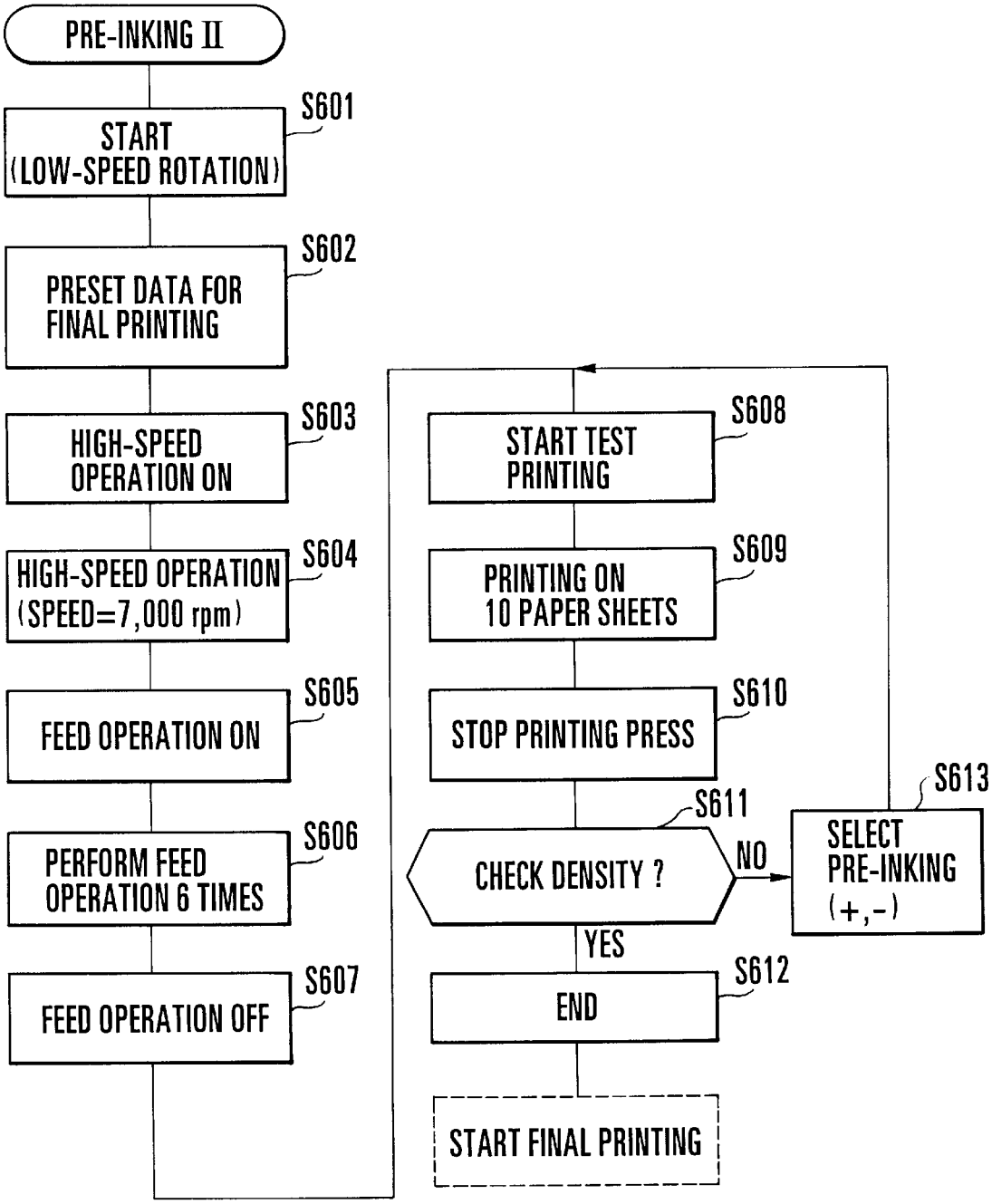
FIG. 6 is a flow chart for explaining an ink film thickness control operation based on "pre-inking II"

In FIG. 6, the CPU 8 sends an instruction to the printing control unit 14 to rotate the printing press at a low speed (step S601). Next, the CPU 8 sends an instruction to the aperture ratio control unit 17 and the rotation ratio control unit 16 to preset the aperture ratio of each ink fountain key 4 and the rotation ratio of the ink fountain roller 3 to values corresponding to the image of the new printing plate 7 (step S602). More specifically, the CPU 8 reads out the image area ratio for each zone of the printing plate 7 corresponding to each ink fountain key 4 from the floppy disk set in the drive unit 18. The aperture ratio of each ink fountain key 4 and the rotation ratio of the ink fountain roller 3 are obtained in correspondence with the readout image area ratio and preset as data for final printing.

Next, the CPU 8 sends an instruction to the printing control unit 14 to start the high-speed operation (step S603), thereby operating the printing press at a high speed (step S604). When the printing press reaches a predetermined operation speed (7,000 rpm), the CPU 8 sends an instruction to the feed control unit 15 to start the ink feed operation (step S605). After the feed operation by the ink ductor roller 5 is performed six times (step S606), the feed operation is stopped (step S607). With this operation, the minimum ink film thickness distribution M*a* necessary during printing, which is formed on the ink roller group 6, is superposed with the ink film thickness distribution M*b* corresponding to the image of the printing plate 7, as shown in FIGS. 4B and 4C.

Next, the CPU 8 sends an instruction to the printing control unit 14 to start test printing (step S608). After test printing is performed 10 times (step S609), the printing press is stopped (step S610). The operator checks the density of test-printed matter (step S611). If the test-printed matter has a satisfactory color tone, ink film thickness control based on "pre-inking II" is ended (step S612), and final printing starts (step S613).

If, in step S611, the test-printed matter has no satisfactory color tone, the operator selects "pre-inking (+)" or "pre-inking (−)" on the ink film thickness control screen of the display 13 (step S613). With this processing, the ink supply amount can be finely adjusted so that an almost satisfactory color tone can be obtained. Ink film thickness control based on "pre-inking (+)" or "pre-inking (−)" will be described later.

In "pre-inking II", the number of times of the feed operations in step S606 is set to be six, and the number of test-printed matters in step S609 is set to be 10. However, these values are not limited and can be changed in accordance with the situation.

[Pre-Inking (+)]

When the test-printed matter in "pre-inking I" or "pre-inking II" has no satisfactory color tone, and fine adjustment is to be made to obtain a relatively high color tone because of various printing conditions or quality desired by the user, "pre-inking (+)" is selected on the ink film thickness control screen of the display 13 (step S118 in FIG. 1 and step S613 in FIG. 6). In this selection of "pre-inking (+)", a fine adjustment amount ΔD by "pre-inking (+)" is simultaneously input.

Figure 7:
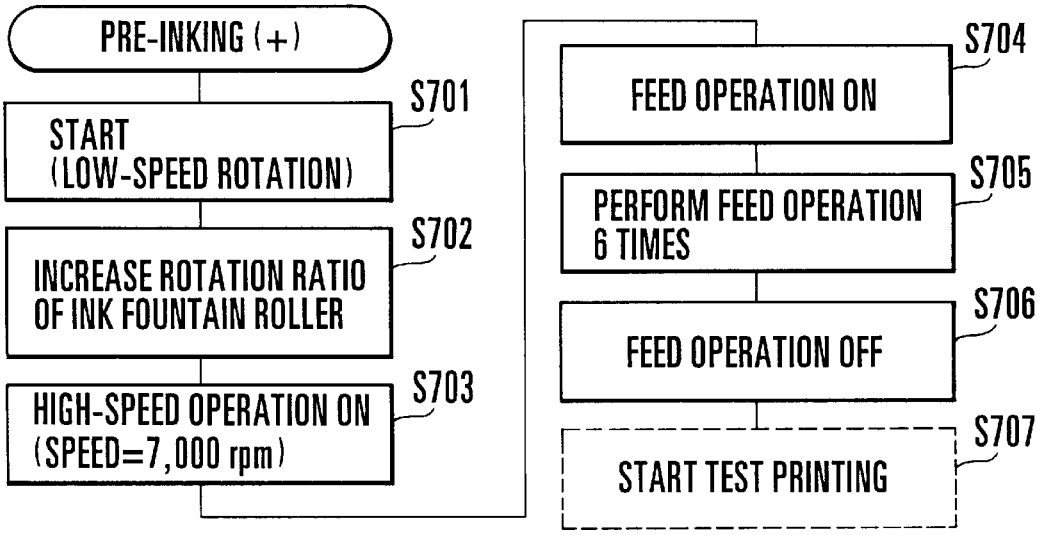
FIG. 7 is a flow chart for explaining an ink film thickness control operation based on "pre-inking (+)"

In FIG. 7, the CPU 8 sends an instruction to the printing control unit 14 to rotate the printing press at a high speed (step S701). The CPU 8 also sends an instruction to the rotation ratio control unit 16 to increase the rotation ratio of the ink fountain roller 3 in accordance with the fine adjustment amount ΔD (step S702).

The CPU 8 sends an instruction to the printing control unit 14 to start a high-speed operation (step S703). When the printing press reaches a predetermined operation speed.(7,000 rpm), the CPU 8 sends an instruction to the feed control unit 15 to start the ink feed operation (step S704). After the feed operation by the ink ductor roller 5 is performed six times (step S705), the feed operation is stopped (step S706). With this operation, the ink film thickness distribution (M*a*+M*b*) formed on the ink roller group 6 is superposed with an ink film thickness distribution M*c* (not shown) corresponding to the fine adjustment amount ΔD such that the ink film becomes thinner from the upstream to the downstream.

In "pre-inking I", the flow returns to step S113, as shown in FIG. 1, or in "pre-inking III", the flow returns to step S608, as shown in FIG. 6, to start test printing.

During control of the film thickness based on "pre-inking (+)", the aperture ratio of the ink fountain key is set in correspondence with the image of the printing plate 7. Therefore, the ink is not supplied to undesired portions other than portions corresponding to the image of the printing plate 7.

[Pre-Inking (−)]

When the test-printed matter in "pre-inking I" or "pre-inking II" has no satisfactory color tone, and fine adjustment is to be made to obtain a relatively low color tone because of various printing conditions or quality desired by the user, "pre-inking (−)" is selected on the ink film thickness control screen of the display 13 (step S118 in FIG. 1 and step S613 in FIG. 6). In this selection of "pre-inking (−)", the fine adjustment amount ΔD by "pre-inking (−)" is simultaneously input.

Figure 8:
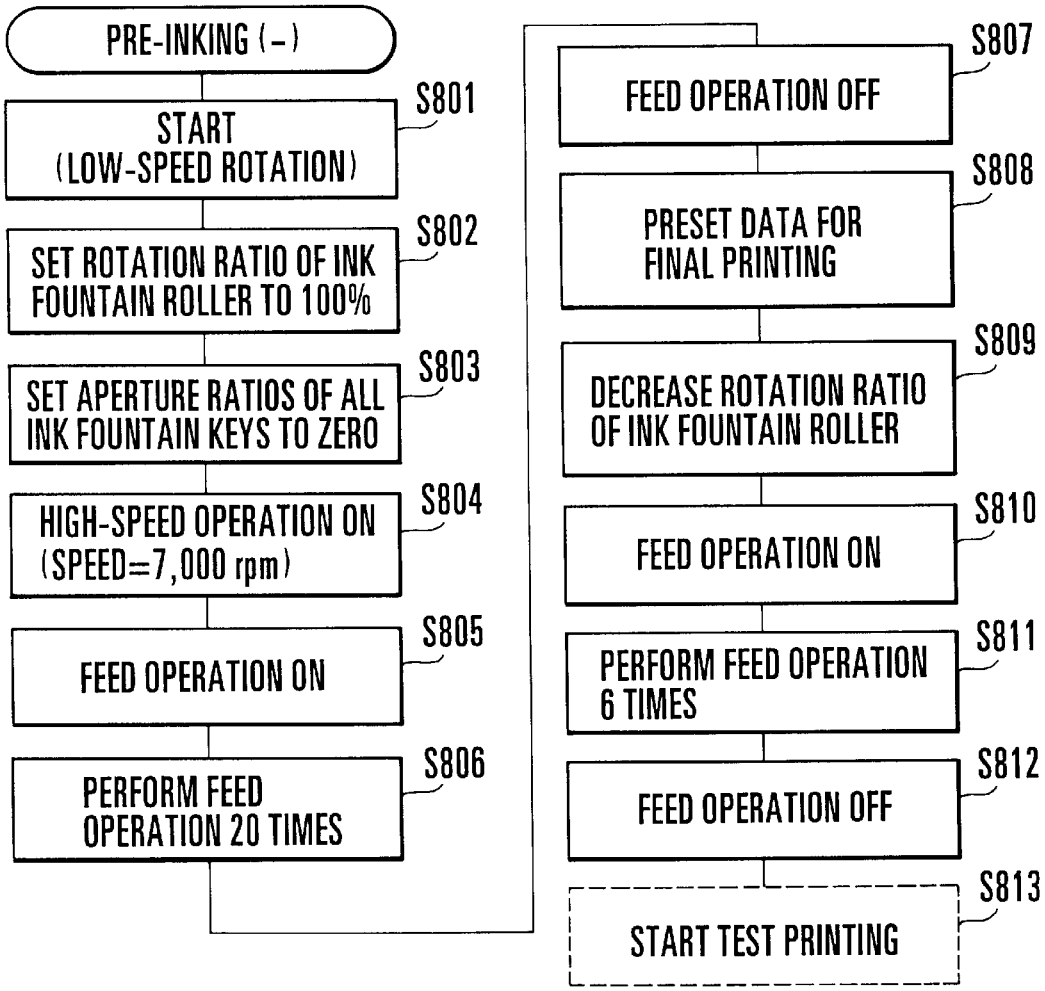
FIG. 8 is a flow chart for explaining an ink film thickness control operation based on "pre-inking (−)"

In FIG. 8, the CPU 8 sends an instruction to the printing control unit 14 to rotate the printing press at a high speed (step S801). The CPU 8 also sends an instruction to the rotation ratio control unit 16 to set the rotation ratio of the ink fountain roller 3 to be 100% (step S802). The CPU 8 also sends an instruction to the aperture ratio control unit 17 to set the aperture ratio of each ink fountain key 4 to be zero (step S803).

The CPU 8 sends an instruction to the printing control unit 14 to start a high-speed operation (step S804). When the printing press reaches a predetermined operation speed (7,000 rpm), the CPU 8 sends an instruction to the feed control unit 15 to start the ink feed operation (step S805). After the feed operation by the ink ductor roller 5 is performed 20 times (step S806), the feed operation is stopped (step S807). With this operation, the ink on the ink roller group 6 is recovered to an ink fountain 1 so that the minimum ink film thickness distribution M*a* necessary during printing is left on the ink roller group 6.

The ink recovery time (the number of-times of ink feed operations) in step S806 can be obtained from the preset data in final printing for the printing plate 7. More specifically, the ink supply amount can be known on the basis of the preset data in final printing, and the time necessary for recovering the ink left on the ink roller group 6 to the ink fountain 1 under predetermined conditions can be known. When this relationship is defined by performing a test a number of times, the ink recovery time for leaving the minimum ink film thickness distribution M*a* necessary during printing can be obtained. The ink recovery time can be freely set by the operator by an input operation using a ten-key pad or the like.

In this way, the minimum ink film thickness distribution M*a* necessary during printing is left on the ink roller group 6. Thereafter, the CPU 8 presets data for final printing (step S808), as in step S109 or S602. Next, the CPU 8 sends an instruction to the rotation amount control unit 16 to decrease the preset rotation ratio of the ink fountain roller 3 in accordance with the fine adjustment amount ΔD (step S809).

The CPU 8 sends an instruction to the feed control unit 15 to start the ink feed operation (step S810). After the feed operation by the ink ductor roller 5 is performed six times (step S811), the feed operation is stopped (step S812). With this operation, the ink film thickness distribution M*a* formed on the ink roller group 6 is superposed with the ink film thickness distribution M*b* obtained by uniformly subtracting the ink film thickness distribution M*c* corresponding to the fine adjustment amount ΔD. In "pre-inking I", the flow returns to step S113 in FIG. 1, or in "pre-inking II", the flow returns to step S608 in FIG. 6 to start test printing.

In this "pre-inking (−)", the ink film thickness distribution M*b* left on the ink roller group 6 in correspondence with the image of the printing plate 7 is removed first to leave the minimum ink film thickness distribution M*a* necessary during printing, and then the minimum ink film thickness distribution M*a* is superposed with the ink film thickness distribution M*b* obtained by subtracting the ink film thickness distribution M*c* corresponding to the fine adjustment amount ΔD. With this processing, the waste paper can be decreased.

More specifically, once the ink is excessively supplied, the initial state can hardly be restored by printing on blank paper sheets. This requires wasteful printing on blank paper sheets, and increases the waste paper. To prevent this, in "pre-inking (−)", the rotation ratio of the ink fountain roller 3 is decreased, and additionally, the ink film thickness distribution M*a* is superposed with the ink film thickness distribution M*b* again from the beginning.

As described above, according to this embodiment, when "pre-inking I" is selected on the ink film thickness control screen of the display 13, the minimum ink film thickness distribution M*a* necessary during printing is formed on the ink roller group 6 without any ink such that the ink film becomes thinner from the upstream to the downstream. The ink film thickness distribution M*a* is superposed with the ink film distribution M*b* corresponding to the image of the printing plate 7. With this operation, the time until the ink film thickness distribution is equilibrated is shortened. Shortening of the preparation time for printing, reduction of the work load, and saving of printing materials can be attained to realize an increase in production efficiency and cost reduction.

More specifically, the number of times of ink supply amount adjustment and test printing which are conventionally performed before final printing can be largely decreased to shorten the preparation time for printing. Although the operator conventionally suffers a large work load to obtain an optimum printing quality (color tone), the work load can be reduced to facilitate the operation. In addition, since the number of times of test printing largely decreases, the consumption quantity of printing paper or ink is largely reduced. Furthermore, since most part of the operation is automatically controlled, no special skill is required for the operation. With these advantages, the productivity can be improved, and reduction in production cost can be realized.

According to this embodiment, "ink removing" is selected on the ink film thickness control screen on the display 13 before exchange of the printing plate, and "pre-inking II" is selected after the printing plate is changed to the printing plate 7. With this operation, after the minimum ink film thickness distribution M*a* necessary during printing is left on the ink roller group 6 such that the ink film become thinner from the upstream to the downstream, the ink film thickness distribution M*a* is superposed with the ink film thickness distribution M*b* corresponding to the image of the printing plate 7. This operation largely shortens the time until the ink film thickness distribution for the previous printing plate is changed to the ink film thickness distribution for the new printing plate 7. Shortening of the preparation time for printing, reduction of the work load, and saving of printing materials can be attained to realize an increase in production efficiency and cost reduction.

Figures 9A, 9B, 9C:
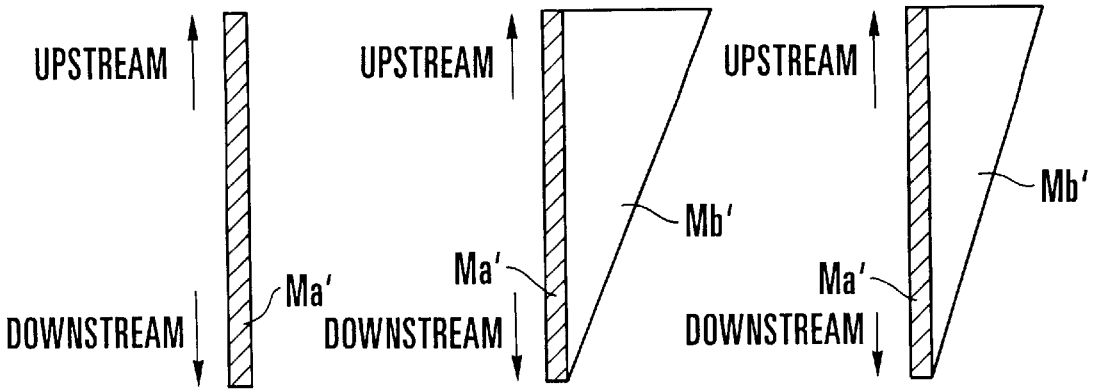
FIGS. 9A to 9C are views for explaining formation of an ink film thickness distribution M*a*' with a uniform thickness.

The printing press may be idled for a predetermined time between steps S108 and S109 to form a minimum and uniform ink film thickness distribution M*a*' on the entire ink roller group 6, as shown in FIG. 9A, on the basis of U.S. Pat. No. 4,660,470. In this case, however, the printing press must be idled for a predetermined time after the feed operation is stopped, resulting in an excess time. In addition, as is apparent from a comparison between FIGS. 9B and 9C and FIGS. 4B and 4C, since the ink amount which must be supplied after preset of data for final printing to superpose an ink film thickness distribution M*b*' in correspondence with the image of the printing plate increases, a long time is required to supply the ink particularly to portions with a few images.

Alternatively, on the basis of U.S. Pat. No. 5,010,820, in "pre-inking (−)", the rotation ratio of the ink fountain roller 3 may be set to be 100%, the feed operation may be started, all ink on the ink roller group 6 may be recovered to the ink fountain 1, the ink film thickness distribution for previous printing may be canceled, and data for next printing may be set to form an ink film thickness distribution for next printing. In this case, however, since all ink is recovered, data for next printing is set, and the ink film thickness distribution for next printing is formed from the beginning, a long time is required. Particularly, at portions with a few or no images, a long time is required because the low speed of ink supply.

As is apparent from the above description, according to the present invention, when the ink roller group has no ink, the minimum ink film thickness distribution necessary during printing is formed on the ink roller group such that the ink film become thinner from the upstream to the downstream. For this reason, the time until the ink film thickness distribution is equilibrated is shortened, and an increase in production efficiency and cost reduction can be realized.

Before exchange of the printing plate, the minimum ink film thickness distribution necessary during printing is left on the ink roller group such that the ink film becomes thinner from the upstream to the downstream. This operation largely shortens the time until the ink film thickness distribution for the previous printing plate is changed to the ink film thickness distribution for the new printing plate, so that an increase in production efficiency and cost reduction can be realized.

What is claimed is:

1. An ink film thickness control method for an ink supply apparatus including an ink fountain for storing an ink, a plurality of ink fountain keys whose aperture ratios are independently adjusted to supply said ink in said ink fountain, an ink fountain roller to which said ink is supplied through said ink fountain keys, and an ink ductor roller for supplying said ink supplied to said ink fountain roller to a printing plate through an ink roller group in accordance with a feed operation, comprising the steps of:

(a) setting the aperture ratios of all said ink fountain keys to an identical value and a rotation ratio of said ink fountain roller at predetermined values when said ink roller group has no ink;

(b) rotating said ink roller group;

(c) performing the feed operation of said ink ductor roller a predetermined number of times to uniformly form a first minimum ink film thickness distribution necessary for printing in an axial direction of said ink roller group such that an ink film becomes thinner from upstream to downstream by adjusting aperture ratios of said ink fountain keys and the rotation ratio of said ink fountain roller; and (d) presetting aperture ratios of ink fountain keys and the rotation ratio of said ink fountain roller to a value corresponding to an image of said printing plate, and performing the feed operation of the ink ductor roller a predetermined number of times to superimpose the first ink film thickness distribution on an ink roller group with a second ink film thickness distribution corresponding to the image of said ink printing plate.

2. A method according to claim 1, further comprising the steps of performing test printing on a predetermined number of paper sheets after formation of the ink film thickness distribution on said ink roller group, thereby checking a color tone of printing matters, and increasing/decreasing at least the second ink film thickness distribution on said ink roller group to finely adjust the color tone of said printing matters if the color tone of said printing matters is unsatisfactory.

3. A method according to claim 2, wherein the step of increasing/decreasing the second ink film thickness distribution comprises inputting a color tone fine adjustment amount for a relatively high color tone when the color tone of said printed matters is too low, increasing the rotation ratio of said ink fountain roller in accordance with the input color tone fine adjustment amount, starting to operate said printing press to rotate said ink roller group, and performing the feed operation of said ink ductor roller a predetermined number of times to further superpose the second ink film thickness distribution on said ink roller group with a third ink film thickness distribution for fine adjustment of the color tone.

4. A method according to claim 2, wherein the step of increasing/decreasing the second ink film thickness distribution comprises inputting a color tone fine adjustment amount for a relatively low color tone when the color tone of said printed matters is too high, setting the aperture ratios of said ink fountain keys to be zero and setting the rotation ratio of said ink fountain roller to be 100%, starting to operate a printing press to rotate said ink roller group, performing the feed operation of said ink ductor roller a predetermined number of times to remove the second ink film thickness distribution on said ink roller group, setting the aperture ratios of said ink fountain keys to a value corresponding to the image of said printing plate, and simultaneously, setting the rotation ratio of said ink fountain roller at a value obtained by subtracting a value corresponding to the input color tone fine adjustment amount from a predetermined value, and performing the feed operation of said ink ductor roller a predetermined number of times to superpose the first ink film thickness distribution on said ink roller group with a third ink film thickness distribution obtained by subtracting the input color tone fine adjustment amount.

* * * * *